United States Patent [19]

Hutterer

[11] 3,981,638

[45] Sept. 21, 1976

[54] ROTARY PISTON MACHINE

[75] Inventor: Johann Hutterer, Vienna, Austria

[73] Assignee: David Godfrey Williams, Merseyside, England; a part interest

[22] Filed: Mar. 24, 1975

[21] Appl. No.: 561,217

[30] Foreign Application Priority Data

Mar. 25, 1974 Austria ..... 2439/74

[52] U.S. Cl. ..... 418/34; 418/36; 418/140; 123/8.47

[51] Int. Cl.[2] ..... F01C 1/42; F02B 55/14

[58] Field of Search ..... 418/34, 36, 37; 123/8.47

[56] References Cited

UNITED STATES PATENTS

| | | | |
|---|---|---|---|
| 3,169,487 | 2/1965 | Namikawa | 418/36 X |
| 3,398,643 | 8/1968 | Schudt | 418/36 |
| 3,592,571 | 7/1971 | Drury | 418/36 |

FOREIGN PATENTS OR APPLICATIONS

| | | | |
|---|---|---|---|
| 207,092 | 2/1909 | Germany | 418/36 |
| 160,125 | 3/1921 | United Kingdom | 418/36 |
| 396,253 | 8/1933 | United Kingdom | 123/8.47 |

*Primary Examiner*—C. J. Husar
*Assistant Examiner*—Leonard Smith
*Attorney, Agent, or Firm*—Imirie, Smiley & Linn

[57] ABSTRACT

A rotary piston machine which has a substantially annular working space, which is divided by bars or the like dividing elements into a plurality of sealed chambers, the volumes of which are periodically changed. The bars or the like dividing elements are carried by two coaxial drums or pistons, which perform a differential rotational movement. The differential gear for the pistons comprises a bevel gear assembly, which comprises four bevel wheels, which mesh with each other. Two of said bevel wheels are coaxial with said pistons. The other two of said bevel wheels are centered on an axis which is at right angles to the axis of the pistons. The differential gear assembly also comprises an epicyclic gear or planet wheel assembly. One of said rotary pistons is operatively coupled by a shaft to one of said coaxial bevel wheels, and the other of said coaxial bevel wheels is freely rotatable relative to said shaft but is operatively coupled to the other of said rotary pistons. The bevel wheels centered on said axis which is at right angles to the axis of said pistons are connected by eccentric mechanisms to respective ones of said planet wheels and are driven in alternate senses of rotation.

8 Claims, 14 Drawing Figures

ROTARY PISTON MACHINE

SUMMARY OF THE INVENTION

A rotary piston machine comprising two rotary pistons, which perform a differential rotational movement and define between them an annular working space, which is divided by bars. The rotary pistons are connected by a differential gear assembly, which comprises a bevel gear assembly and an epicyclic gear assembly. The bevel gear assembly consists of four bevel wheels, which mesh with each other. Those bevel wheels which are coaxial with the working space are connected to respective ones of the rotary pistons, the other bevel wheels are connected by eccentric mechanisms to respective ones of said planet wheels.

This invention relates to a rotary piston machine which comprises an outer rotary piston and an inner rotary piston which define at least in part an annular working space, which is divided into chambers by bars, which extend in alternation from one of the rotary pistons and the other. The rotary pistons are interconnected by a differential gear assembly and perform a differential rotational movement so that the volumes of the chambers are periodically changed.

It has already been proposed to provide a rotary piston internal combustion engine having a central axis and comprising a radially outer piston carrier and radially inner piston carrier, which piston carriers define between them an annular working space. In said machine, the hub of the inner piston carrier contains an annular cavity, which is axially confined on both sides by side members and serves to compress air. Two pairs of diametrically opposite pistons are carried by the radially outer piston carrier. Two pairs of diametrically opposite pistons are carried by the radially inner piston carrier. Said diametrically opposite pistons revolve in said cavity in the same angular orientation as respective pistons revolving in said annular working space. The movement of the pairs of pistons relative to each other is controlled by a gear. The gears provided for this purpose are expensive and can transmit only relatively small torques.

It is an object of the present invention to eliminate this disadvantage. This is accomplished according to the invention in that one of the rotary pistons is operatively coupled by a shaft to a coaxial bevel wheel of a bevel gear. The latter comprises a second coaxial bevel wheel, which is arranged in mirror symmetry to the first-mentioned bevel wheel and which is freely rotatably mounted on said shaft but is operationally coupled to the other of the rotary pistons. These two bevel wheels are in mesh with at least one additional bevel wheel, which rotates on an axis that is at right angles to the axis of rotation of said shaft and which is operatively connected to an epicyclic gear assembly.

It is another object of the invention to provide simple and effective means for sealing the chambers of the working space. This object is accomplished according to the invention in that the rotary pistons are pot-shaped and arranged one within the other and that the inner rotary piston is operationally connected to one of said coaxial bevel wheels by a shaft and the outer rotary piston is operationally to the other of said coaxial bevel wheels by a tubular shaft which surrounds the above-mentioned shaft.

Further features of the present invention will be described in detail with reference to the drawings in which embodiments of the rotary piston engine of the present invention are described.

DETAILED DESCRIPTION OF THE INVENTION

Figure 2:
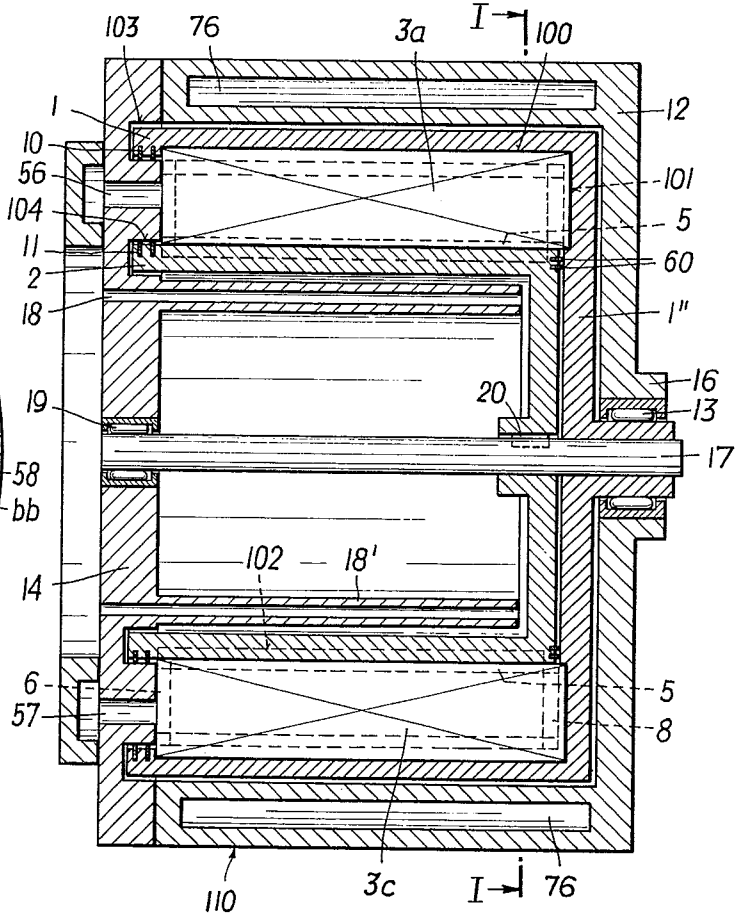
FIG. 2 is an axial sectional view taken along line II—II of FIG. 1.
Figure 3:
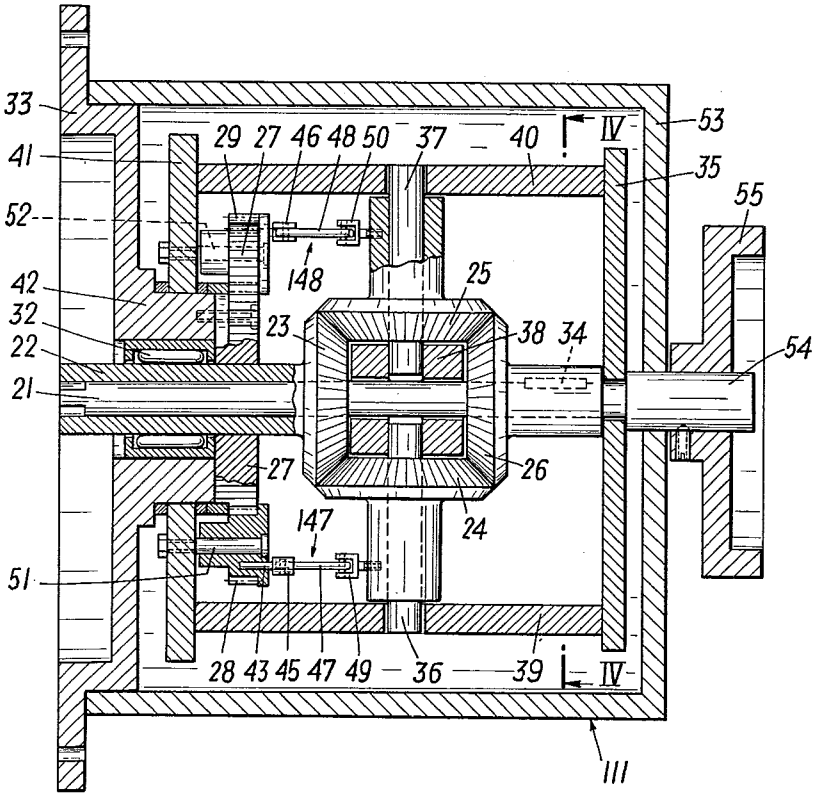
FIG. 3 is an axial sectional view of a gearing assembly according to the present invention.
Figure 5:
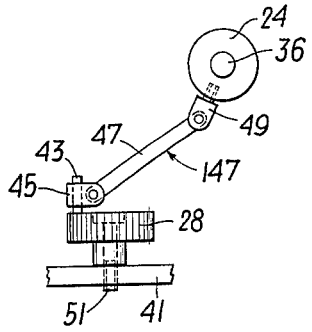
FIG. 5 is a sectional view taken along line V—V of FIG. 4.

The rotary piston engine of the present invention basically comprises a rotary piston member 110, FIG. 2, and a gear transmission mechanism (gear part) 111 FIG. 3, which parts, according to the proposed use of the rotary piston engine, e.g. as a combustion, compressed air, or hydraulic engine, or as a compressor or pump and the like, may have special features of construction in certain parts, within the scope of the present invention.

The rotary piston member 110 is provided with two rotary drums or pistons 1 and 2 mounted one within the other in a substantially pot-shaped housing 12 closed by a cover plate 14 and in each case preferably provided with four bars or lanes 3*a* to 3*d* and 4*a* to 4*d;* said pistons executing rotary movement in the same direction and having a periodically changing ratio of their angular velocities (speed) and enclosing between their concentric cylindrical casings 1', 2' annular space A forming the working space. The annular space A between the rotary pistons 1 and 2 is divided into working chambers *aa*, *ab*, *bb*, *bc*, *cc*, *cd* and *da* by the piston bars 3*a* – 3*d* and 4*a* – 4*d* extending substantially over the entire depth and length of the annular space. For each working chamber there results a quadruple enlargement and reduction during rotation of the two rotary pistons through 360° so that, in the preferred embodiment, there occurs a total of 64 changes of volume per cycle.

As will be described hereinafter in greater detail, the enlargement and reduction of the working chambers, dependent on the gear transmission, always occurs at identical points in the path of rotation, resulting in the possibility of carrying out the supply and removal of the operating medium in a very simple manner by means of associated openings in the stationary housing, and of dispensing with controlled valves.

The outer, substantially pot-shaped rotary piston 1 is mounted to rotate in a roller bearing 13 of the housing 12 by means of a hollow bearing pin 16 provided on the base plate 1''. The piston bars 3*a* – 3*d* are fitted in recesses 100 – 101 on the inner casing and base surface of the rotary piston 1. The similarly pot-shaped rotary piston 2 is firmly connected by a key 20 to a shaft 17 which in turn is mounted to rotate on the bearing pin 16 and in a locking bearing 19 provided co-axially in a cover plate 14. The piston bars 4*a* – 4 *d* in the rotary piston 2 are inserted in grooves 102 of the outer casing of the rotary piston 2. The open ends of the rotary pistons 1 and 2 are closed by the cover 14 of the housing in which the rotary pistons simultaneously run with sealing rings 10 and 11 in annular grooves 103, 104 provided therein. Parts of the shaft 17 and the bearing pin 16 extending out of the housing 12 are formed, for example, as a claw clutch so that, after the connection of the rotary piston member 110 with the gearing mechanism 111, they form a detachable driving connection with corresponding gearing shafts 21 and 22 provided therein.

For cooling the rotary piston engine in general, cooling water chambers 76 are provided in the housing 12 for cooling the outer piston 1. On the housing cover 14, cooling elements 18' extending into the cavity of the piston 2 and provided with hollow chambers 18 for receiving cooling liquid are mounted for cooling the inner piston 2.

The sealing of the working chambers *aa* – *da* is preferably effected by sealing strips 5– 9 which are inserted in grooves. In the case of the rotary piston 1, the sealing strips 5 are provided axially on the bars 3*a* – 3*d*, said strips sliding on the surface of the piston 2, and the sealing strip 6 are radially inserted to slide on the housing plate 14. Similarly in the case of the rotary piston 2, there are provided axial sealing strips, which slide on the inner surface of the piston 1, radial sealing strips 8 which slide on the base surface of the piston 1, and radial sealing strips 9 which slide on the housing plate 14. The external seal of the chambers is obtained by means of the sealing rings 10 and 11 of the pistons 1 and 2 and by means of a sealing ring 60 between the two pistons.

Figure 13:
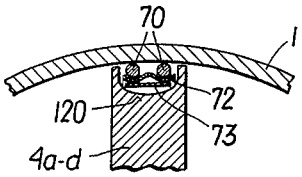
FIG. 13 is a sectional view in detail showing the sealing strips according to the present invention.
Figure 14:
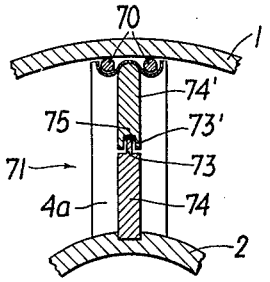
FIG. 14 is a sectional view of a detail showing the radial sealing strips of the present invention.

Round, roller-like sealing strips (members) 70 (FIG. 13) may be provided according to the present invention, externally of or adjacent to the conventional sealing elements, and in the case of certain embodiments of the rotary piston engine, divided strips 71 (FIG. 14) may be provided on the piston bars in the longitudinal direction and on their flat side surfaces. As may be seen from FIG. 13, the roller-shaped sealing strips 70, pressed by means of a flat spring 73 against the surface of the piston 1 and thus sealing both adjacent chambers, may be disposed in a shaped cavity 72 located in a longitudinal groove 120 of the piston bar. Due to the low frictional values of a rolling arrangement compared with the sliding arrangement of normal rigid sealing strips, in the proposed embodiment there is a much more favorable degree of mechanical efficiency. The lateral sealing of the rotary pistons is obtained by the divided sealing strips 71 shown in FIG. 14. The sealing strip 71 located in a groove in the side surface of the piston bar 4 and pressed by a spring against the wall of the housing in the usual manner, comprises a part 74' formed with a slot 73' and part 74 provided with a tongue 73 fitting the slot 73' and constructed as a graduated slide. A spring 75 inserted between the tongue 73 and the bottom of the slot 73' urges the part 74' against the casing of the piston 1, whilst fixed play between the parts 74 and 74' compensates without limiting the quality of the seal in a very simple manner for the expansion of the material which may be feared from the effect of heat. Obviously, the embodiment of the sealing strip 74, 74' may also be used in a similar manner also as an axial seal, instead of the roller strips.

It is within the scope of the present invention to manufacture the rotary pistons or bars of plastic material which hardly changes its dimensions within the given range of temperature and has very good sliding properties, and in such case a sealing system would be unnecessary.

As may be seen from FIG. 3, the part 111 of the gearing substantially comprises the bevel gears 23, 24, 25, 26, the epicyclic gear gears 27, 28, 29 and the coupled drive 147, 148 which parts by means of the shafts 21, 22 effect the above-described movements of the two rotary pistons 1 and 2.

The bevel gear assembly, which comprises two bevel gear wheels 23 and 26 located at a space from each other on a shaft 21 and facing each other by their bevel surfaces, as well as two bevel gear wheels meshing therewith at diametrically opposed places and also facing each other, is journalled to rotate freely within the housing. The bevel gear wheel 23 is disposed on the shaft 21 and is coupled, by way of a hollow rotary member 22 mounted in a locking bearing 32 of a housing plate 33 to be closed on the housing 12, with the bearing pin 16 when the parts 110 and 111 are connected together. Consequently, gear 23 is operatively connected with the rotary piston 1, whilst the bevel gear wheel 26 is connected by a key 34 to the shaft 21 which, journalled on the rotary member 22 and a bearing plate 35, is connected by the shaft 17 to the rotary piston 2. Both bevel gear wheels 24, 25 are disposed with their hubs to rotate freely on shafts 36, 37 which extend co-axially to each other and are journalled at their outer ends on bearing bars (strips) 39, 40 which are mounted on a plate 41 freely rotatable on the extension 42 of the housing. The inner ends of the shafts 36, 37 engage in a bearing block 38 which is rotatable on the shaft 21 and arranged between the bevel gears.

The epicyclic gear assembly is for example provided on the extension 42 of the housing plate 32 with a sun wheel 27 fixed in position on said extension 42, and two diametrically opposed planet wheels 28, 29 meshing with said sun wheel and journalled to rotate on the bearing pins 51, 52 firmly mounted on the plate 41; said planet wheels being connected to the hubs of the bevel gear wheels 24, 25 by the already mentioned respective coupling drives. Each of these coupling drives comprises an articulated fork 45 and 46 which is mounted to rotate on a pin 43 and 44 eccentrically provided on the planet wheel 28, 29, as well as an articulated rod 47 and 48 mounted between the prongs of the fork 45, 46, said rod carrying at its end remote from the articulated fork 45, 46 another articulated fork 49, 50 which is in rotatable connection with the hubs of the bevel gear wheels 24, 25. The outer and inner rotary pistons are therefore positively connected and controlled by the coupling drives and the epicyclic gear via the bevel gear wheels, the coupling drives moving the bevel gear wheels 24, 25 alternately in one direction and the other and thus effecting the differential rotary movement of the rotary pistons.

Since in general the performance of rotary piston engines depends on the change of volume of the working chambers formed by the rotary pistons in their rotation during a working cycle, whilst the amount of the change of volume in turn is determined, by the degree of the eccentricity of the bearing pins 43, 44 on the gear wheels 28, 29, an adjustable bearing arrangement of the pin 43, 44 on the planet wheel 28, 29 is provided and, conditioned thereby, an articulated rod 47, 48 of adjustable length, in order to obtain optimal adaptation of the volume of the chamber, and, hence, of the ratio of compression, to the particular conditions and requirements.

Figure 6:
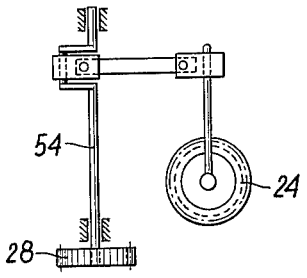
FIG. 6 is a view similar to FIG. 5 showing another embodiment of the gear mechanism of the present invention.

The construction of the gearing is naturally not limited to the illustrated embodiment, but can be carried out, according to the given requirements, with, for example, only one planet wheel or with a maximum of four planet wheels with the corresponding coupling members, as shown in FIG. 6, by means of a crahk shaft 54.

The gear mechanism is mounted to rotate in the housing 33 by the shaft 54 rigidly connected to the bearing plate 35. According to the proposed use of the rotary piston engine, the shaft 54 may have a driving wheel as compressor, or a driven wheel 55 as motor and may also be constructed simultaneously as a fly wheel, if desired.

The transmission ratio of the gear wheels 28, 29 of the epicyclic gear depends on the number of operating chambers required. In the embodiment according to the present invention with eight working chambers, the transmission ratio amounts to 1 : 4. With one rotation of a planet wheel, the rotary pistons 1 and 2 move in succession through 90° in each case in the fixed direction of rotation.

In the embodiment of the rotary piston member shown in FIG. 2, a distributor ring 15 having an inlet passage and an outlet passage is provided for the use thereof as an internal combustion engine for the supply of fuel and for the removal of the combustion gases, these passages communicating, through corresponding passages 56, 57 with the closure plate 14, directly with the individual working chambers which are kept closed or open in a fixed sequence during the rotation of the bars of the rotary piston, i.e. are located above an inlet or outlet passage.

FIGS. 7 – 11 show the course of a working cycle of a rotary piston engine preferably provided as an internal combustion engine, which in its mode of operation corresponds to the normal 4-stroke cycle.

Figure 1:
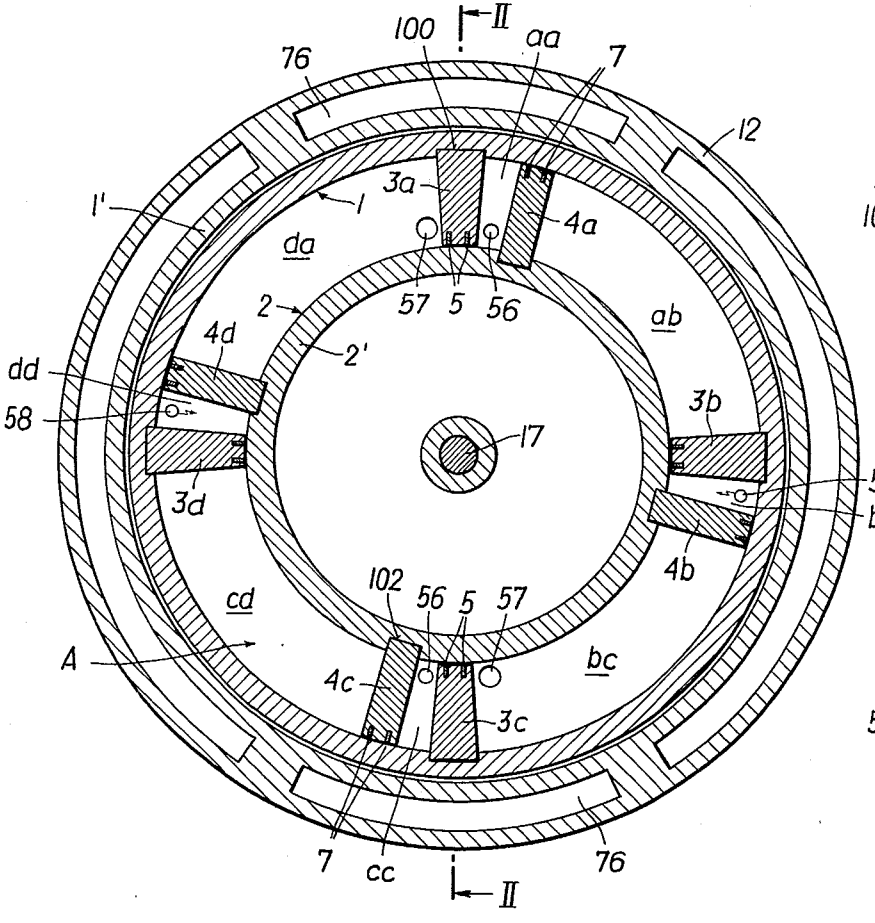
FIG. 1 is a cross-sectional view of a rotary piston assembly according to the present invention.
Figure 4:
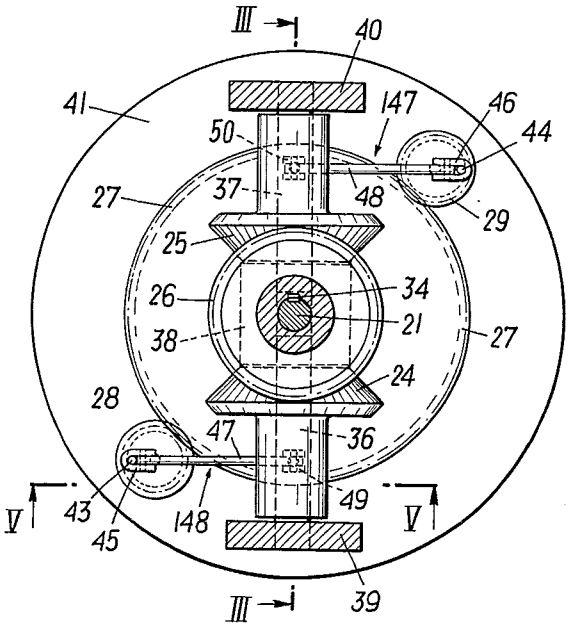
FIG. 4 is a sectional view of the gearing assembly taken along line IV—IV of FIG. 3.
Figure 7:
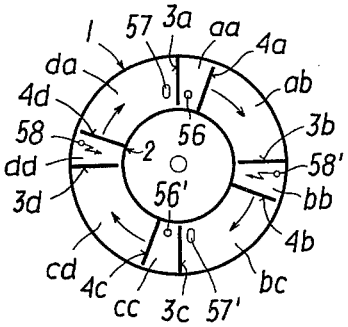
FIGS. 7–11 are schematic diagrams which illustrate different working phases of the rotary pistons of the present invention through 180°.

In the position shown in FIG. 7, which corresponds to the position shown in FIG. 1, suction takes place in the chambers *aa*, *cc*, with which the inlet passages 56, 56′ communicate, since these chambers will enlarge in an assumed clockwise direction as a result of the lead of the piston 2. At the same time the chambers *ab*, *cd*, following the chambers *aa*, *cc*, viewed in the direction of rotation, will decrease and complete the compression. Meanwhile, the explosion takes place in the enlarging chambers, *bb*, *dd*, with which a suitable ignition device 58, 58′, communicates and the exhaust stroke takes place in the following decreasing chambers *bc*, *da*, from which the exhaust passages 57, 57′ lead.

Figure 8:
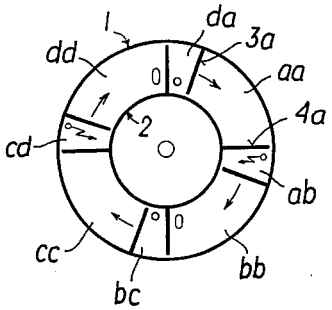
Figure 9:
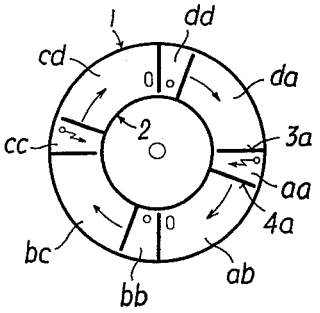
Figure 10:
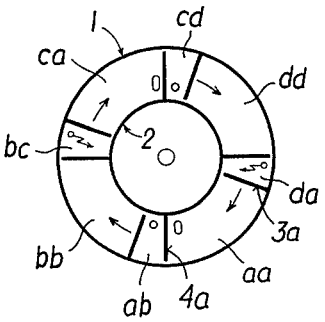
Figure 11:
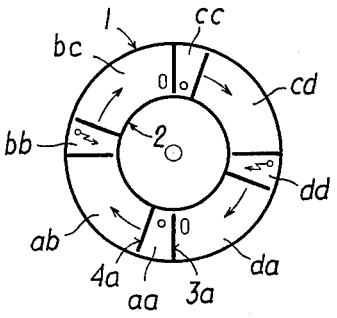

After the rotary pistons 1 and 2 have assumed the position shown in FIG. 8, the lead of the piston 1 begins and thus effects the compression in the chambers *aa* and *cc*, the explosion in the chambers *ab*, and *cd*, the exhaust in the chambers *bb* and *dd*, and the suction in the chambers *bc*, and *da*. In the following sequence according to FIG. 9 the explosion stroke begins in the chambers *aa*, *cc*, the exhaust stroke in the chambers *ab* and *cd*, the suction stroke in the chamber *bb* and *cd*, and the compression stroke in the chambers *bc* and *da*. In the position of the pistons 1, 2 according to FIG. 10, the piston 1 begins its leading movement and begins the exhaust stroke in the chambers *aa*, *cc*, the suction stroke in the chambers *ab*, *cd*, the compression stroke in the chambers *bb*, *dd*, and the expansion stroke in the chambers *bc*, *da*. Finally, FIG. 11 shows the beginning of the next working cycle in which suction (intake) begins in the chambers *aa*, *cc*, the compression in the chambers *ab*, *cd*, the expension in the chambers *bb*, *dd*, and the exhaust in the chambers *bc*, *da*.

FIGS. 7 – 11 show that for one working stroke, and adjustment of a rotary piston through 90° is necessary and an adjustment of 180° of the rotary piston is necessary per working cycle, a total of 32 individual working strokes being obtained, provided of course, that the selected number of bars and the selected transmission ratio of the epicyclic gear assembly is fixed. Purely from the point of view of the working stroke, a two-piston rotary engine with its simultaneously proceeding eight working strokes corresponds approximately therefore to an eight cylinder 4-stroke piston engine.

Figure 12:
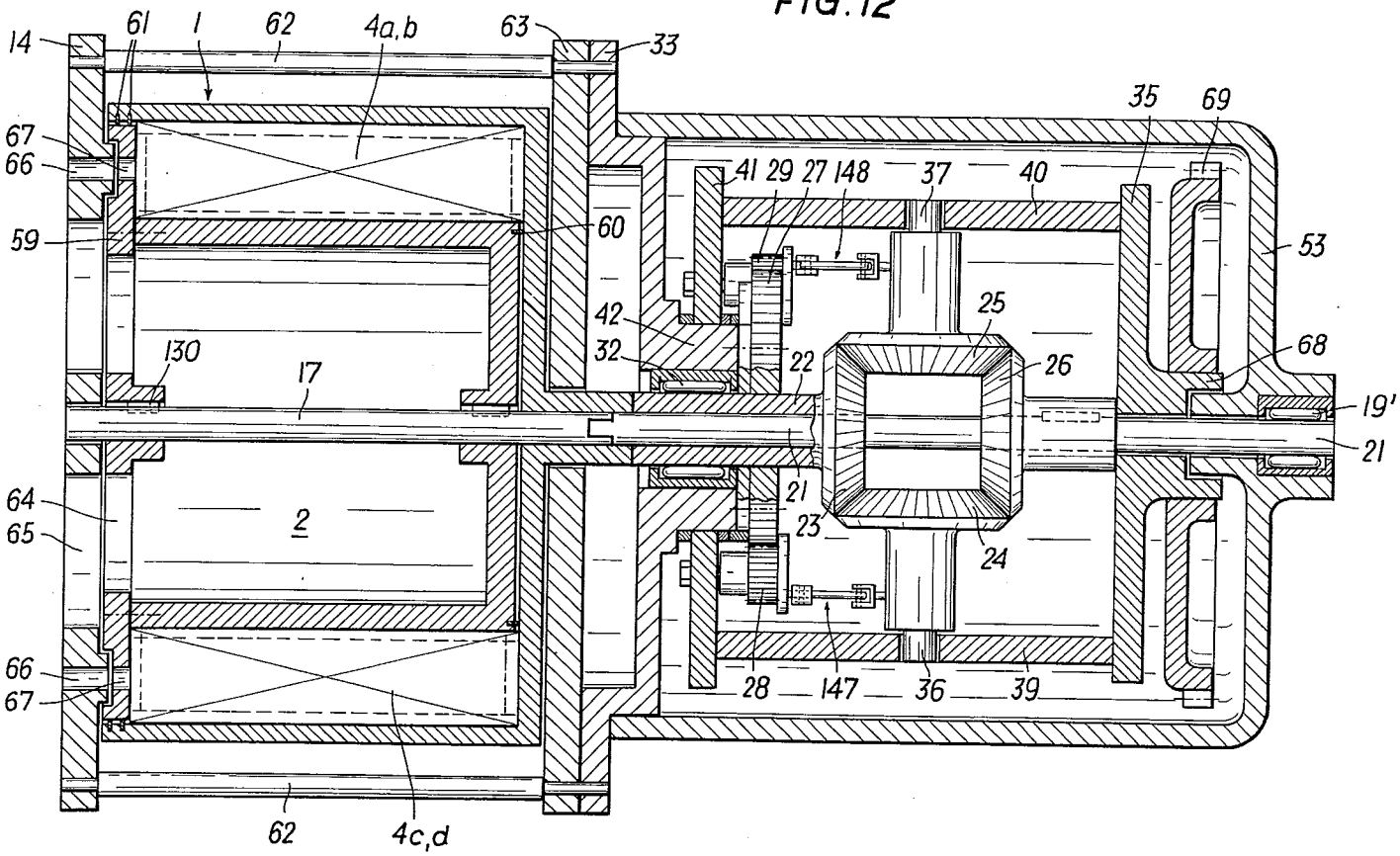
FIG. 12 is a cross-sectional view of another embodiment of the rotary piston engine of the present invention.

With the construction of the rotary piston engine as a liquid pump, starting from the position shown in FIG. 7, the chambers *aa*, *bb*, *cc*, *dd*, begin the suction of the liquid through associated intake passages, whilst the chambers *ab*, *bc*, *cd*, *da*, expel the fluid through corresponding outlet passages. This working cycle continues according to the manner described with reference to FIG. 7 – 11, with the difference that the working strokes are reduced to two strokes, an intake and an outlet stroke and, in each case, four chambers simultaneously execute the same working stroke in the sequence described. As already mentioned, the present invention is not limited to the two possible applications described, but, after relatively minor alterations, which apply mainly to the intake and outlet of the fluid into an out of the chambers, is suitable for the other tyes of internal combustion and working engines. Similarly, the rotary piston engine may be designed for use as compressor, in which a practically impact-free, liquid and continuous feed may be achieved by the construction accordingg to the present invention. Another embodiment according to FIG. 12 provides an annular plate closing the working chambers, connected to the bars **4*a* – 4*d* of the rotary piston 2 and secured to the shaft 17 by means of a key 130, said plate carrying sealing rings 61 for sealing the outer circumference of the chamber, other sealing rings 60 being provided on the outside of the base of the rotary piston 2, whereby the sealing strips 9′, required for sealing the chamber between the two rotary pistons, in the embodiment according to FIG. 2 and provided on the front of the piston bars 4*a* – 4*d*, are unnecessary. The annular plate 59 is preferably constructed, as also the fixed housing plate 14, connected by axial bars 62 to the rear plate 63, with openings 64, 65, in the center area so that the outer surfaces of both pistons 1 and 2** can move in a freely accessible flow of air or any other cooling medium, such as when used as an underwater pump in water.

The operating medium is changed by way of passages 66 provided in the cover plate 14 and made to coincide periodically with corresponding openings 67 communicating with the chambers and formed in the annular plate 59 of the inner rotary piston 2.

In the gear mechanism the bearing plate 35 has a hub 68 freely rotatable on the shaft 21, provided with a driving or driven wheel 69 and journalled in the housing 53. The shaft 21 detachably coupled with the shaft 17 of the rotary piston 2 is journalled in the housing 53 and secured against a return movement by a locking bearing 19'. In this embodiment, it is not necessary to provide a locking bearing in the rotary piston part, since a return of the pistons is prevented by the gear shafts 21, 22.

Obviously, various modifications of construction may be made within the scope of the invention. Several rotary piston units may be coupled together with the shafts 16, 17, with appropriate partitions, this enlarged unit requiring only one gear assembly and locking bearing assembly and constructed on the building block system.

What we claim is:

1. A rotary piston machine comprising an outer rotary piston and an inner rotary piston which define between them an annular working space, which is divided into a plurality of sealed chambers by bars, which extent in alternation from said outer and inner rotary pistons, and a differential gear assembly which operatively connects said outer and inner rotary pistons, which perform a differential rotational movement whereby the volumes of said sealed chambers are periodically changed, said differential gear assembly comprising a bevel gear assembly and an epicyclic gear assembly, said bevel gear assembly having two mutually confronting, coaxial bevel wheels which are coaxial with said annular working space, and two intervening additional bevel wheels, which are in mesh with the two first-mentioned bevel wheels and rotatable on an axis that is at right angles to the axis of rotation of said coaxial bevel wheels, one of said two coaxial bevel wheels being operatively connected to said outer rotary piston, the other of said two coaxial bevel wheels being operatively connected to said inner rotary piston, said epicyclic gear assembly having a sun wheel and two planet wheels in mesh with said sun wheel, said differential gear assembly also comprising connecting means, which connect said planet wheels to respective ones of said additional bevel wheels, said connecting means and planet wheels being operable to impart a rotational movement to said two additional bevel wheels in alternating senses of rotation to produce the differential rotational movement of said rotary pistons, said rotary pistons being pot-shaped and nested one within the other, the shells of said pots defining between them said working space, and the bars which divide said working space being fixed in alternation to the shell of one and the other of said pots.

2. A rotary piston machine as set forth in claim 1, in which said sun wheel is fixed to a housing part, said planet wheels mesh with said sun wheel at diametrically opposite points thereof, each of said planet wheels is operatively connected by an eccentric mechanism to one of said additional bevel wheels.

3. A rotary piston machine as set forth in claim 1, in which said inner rotary piston is operatively connected by a shaft to that one of said coaxial bevel wheels which is more remote from said inner rotary piston and said outer rotary piston is connected by a tubular shaft, which surrounds the above-mentioned shaft, to that one of said coaxial bevel gears which is nearer to said inner rotary piston.

4. A rotary piston machine as set forth in claim 1, in which each of said rotary pistons has an outer rim, which is guided in an associated annular groove formed in a housing cover plate and is sealed against said plate by sealing rings.

5. A rotary piston machine as set forth in claim 1, in which said planet wheels are connected to a gear housing, which revolves in unison with said planet wheels, and an input wheel is connected to said planet wheels.

6. A rotary machine engine as set forth in claim 1, in which said planet wheels are connected to a gear housing, which revolves in unison with said planet wheels, and an output wheel is connected to said gear housing.

7. A rotary piston machine as set forth in claim 1, in which said connecting means comprise two push rods, each of which is provided at its ends with two forks, one of which is eccentrically hinged to one of said planet wheels whereas the other of said forks is hinged to one of said bevel wheels.

8. A rotary piston machine as set forth in claim 1, in which an annular plate covering the front of the working space is secured to the inner rotary piston and the circumferential surface of said plate is provided with sealing rings in contact with the cyclindrical wall of said outer piston.

* * * * *